United States Patent [19]

Kohl

[11] 3,952,551

[45] Apr. 27, 1976

[54] SELF-ALIGNING APPARATUS FOR USE ON A WRAP KNITTING MACHINE

[76] Inventor: Karl Kohl, 10 Chlorodont Strasse, Obertshausen, Germany, 6053

[22] Filed: Dec. 24, 1974

[21] Appl. No.: 536,138

[30] Foreign Application Priority Data

Jan. 15, 1974 Germany ..... 2401687

[52] U.S. Cl. ..... 66/120

[51] Int. Cl.[2] ..... D04B 35/04; D04B 35/06

[58] Field of Search ..... 66/116, 120, 123

[56] References Cited

UNITED STATES PATENTS

| | | | |
|---|---|---|---|
| 1,856,052 | 4/1932 | Gagne | 66/120 |
| 2,300,804 | 11/1942 | Peel et al. | 66/120 |
| 2,522,335 | 9/1950 | Amidon | 66/120 X |
| 2,714,811 | 8/1955 | Amidon | 66/120 X |
| 2,775,108 | 12/1956 | Belli | 66/120 |
| 2,796,606 | 6/1957 | Amidon et al. | 66/120 |
| 2,913,888 | 11/1959 | Amidon | 66/120 X |
| 3,681,944 | 8/1972 | Peschl et al. | 66/120 X |
| 3,828,582 | 8/1974 | Widdowson et al. | 66/123 |

FOREIGN PATENTS OR APPLICATIONS

| | | | |
|---|---|---|---|
| 488,040 | 3/1970 | Switzerland | 66/86 |

*Primary Examiner*—Ronald Feldbaum
*Attorney, Agent, or Firm*—Behr & Woodbridge

[57] ABSTRACT

The closer mechanism of a warp knitting machine equipped with slide needles includes an apparatus which allows the closers to automatically align themselves with respect to the slide needles. The self-aligning apparatus includes a closer mounting means which is slideably engagable in a slot in a closer mounting bar. As the closers engage the slide needles, the self-aligning apparatus allows the closers to become aligned relative to the needles in a position of least resistance.

4 Claims, 3 Drawing Figures

SELF-ALIGNING APPARATUS FOR USE ON A WRAP KNITTING MACHINE

BACKGROUND OF THE INVENTION

1. Description of the Invention

This invention relates to an apparatus for automatically aligning the closers of a warp knitting machine relative to an array of slide needles mounted thereon.

2. Description of the Prior Art

Slide needles and the closer mechanisms associated therewith are known to those of ordinary skill in the warp knitting machine art. Examples of prior art patents discussing the use of slide needles include Cotterill, U.S. Pat. No. 2,339,153; Amidon, U.S. Pat. No. 2,714,811 and Bellini, U.S. Pat. No. 2,775,108. The closer on slide employed in slide needles is frequently also referred to in the prior art as a tongue. The drive mechanisms associated with U.S. Pat. Nos. 2,339,153; 2,714,811; and 2,775,108 may also be employed with the apparatus of the present invention. Such drive mechanisms tend to be relatively conventional.

One of the problems associated with the tongue and groove needle arrangements of the prior art is that an excessive amount of frictional heating and efficiency loss is often associated with the sliding contact relationship of the tongue in the groove. This problem is aluded to in the Amidon U.S. Pat. No. 2,714,811. A major reason for the frictional heat loss and abrasion is that it is very difficult to precisely align the needles and closers. It is a purpose of the present invention to provide a means and apparatus for allowing the closer mechanism to self-align themselves with respect to the needles so that the problems of frictional heat and abrasion are minimized.

SUMMARY OF THE INVENTION

Briefly, in the preferred embodiment of the present invention, a closer slides up and down in a groove in the needle of a warp knitting machine. The grooved hooked needles are mounted on a needle mounting bar and the closers are mounted on a mounting means which is received by a closer bar. The closer mounting means includes an extension which is slideably engagable in a groove in the closer mounting bar. Therefore, the closer mounting means and the closers mounted thereon are free to slide within the grooves of the closer mounting bar. In this fashion, the closers can automatically self-align or self-adjust themselves to the grooves in the hooked needles. Therfore, a good deal of frictional heat and abrasion is eliminated since the freely moving closers will seek the alignment of the least frictional resistance. These and other advantages of the present invention will be more fully appreciated with regard to the following drawings.

DESCRIPTION OF THE INVENTION

Figure 1:
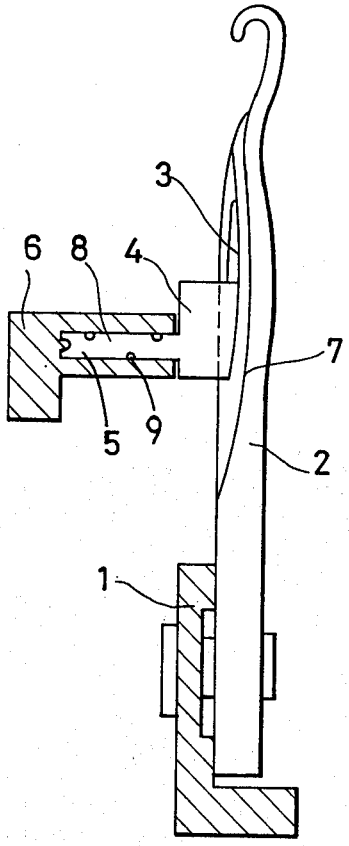
FIG. 1 is a side cross-sectional elevated view of a preferred embodiment of the present invention.
Figure 2:
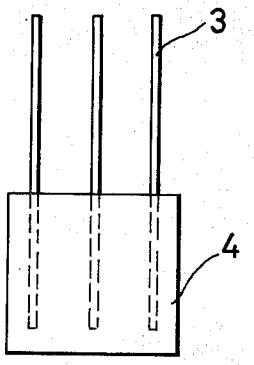
FIG. 2 is a rear elevated view of a closer mounting means including three closers rigidly mounted thereon.

During the course of this description, like numbers will be used to refer to like elements in the different views of FIGS. 1 and 2.

FIG. 1 illustrates in a cross-sectional fashion the nature of the relationships between the closers 3 and the grooved needle 2. While the relative driving mechanisms are not shown in FIGS. 1 and 2, it will be understood to those of ordinary shkill in the art that suitable driving mechanisms are known. Examples of known driving mechanisms are discussed in U.S. Pat. Nos. 2,339,153; 2,714,818 and 2,775,108.

According to FIG. 1, a grooved hook needle 2 is rigidly mounted to a needle mounting bar 1. While only one needle 2 is shown in cross-sectional view, it will be appreciated by those of ordinary skill in the art that such needles are typically aligned in rows or arrays in parallel fashion. Thus, FIG. 1 represents only one of a plurality of hook needles 2 which would reside on a needle mounting bar 1. As is clear from the cross-sectional view of FIG. 1, the hooked needle 2 includes a groove or slot 7 therein which is adapted to receive a closer mechanism 3. Generally one closer 3 is associated with each groove or slot 7 of a grooved hook needle 2. Therefore, for each needle 2 in the array of hook needles, there is typically associated one closer 3 in an array of closers. Closer 3 is attached to a closer mounting means 4 which includes a tongue or extension 8. Closer mounting means extension 8 is slideably received within a groove 5 in a closer mounting bar 6. The groove 5 extends in a direction parallel to the array of knitting needles 2 and allows the mounting means 4 and the closers 3 to move freely in that parallel direction.

In operation, if the closers 3 are precisely aligned with groove 7, then there will be little or no self-adjustment of the apparatus. However, if the closers 3 are out of alignment with grooves 7 of the needles 2, then the forces of the needle 2 on the closers 3 will cause the mounting means 4 to slide to an equilibrium position of least resistance. Because the mounting means 4 is free to slide within the groove 5 the closers 3 will automatically align or adjust themselves within the grooves 7 so as to produce the least frictional heat and abrasion. As a consequence, the warp knitting machine will run more efficiently and with less wear and tear on the knitting elements. The forces which tend to misalign the needle include poor setting or machine elements and the high thread tension associated with such machinery. The problems associated with these undesirable forces are minimized by the use of this invention.

FIG. 2 illustrates another preferred embodiment of the present invention in which a plurality of closers 3 are rigidly mounted in the same mounting means 4. In some circumstances, it may be desirable to mount more than one closer 3 on a mounting means 4 in order to avoid waste and duplication. The optimum number of closers 3 per mounting means 4 is determined in large part by the design of the machine and the forces working on the knitting elements. As a practical matter, the mounting of three closers 3 on a mounting means 4 is a desirable number for many applications. Where a plurality of closers are mounted on the same mounting means, obviously the closers will all move in unison. This is acceptable where the misalignment between adjacent needles is small. Typically, one would expect the misalignment between adjacent needles to be small, but the misalignment between needles that are farther removed to be greater. For this reason, placing a limited number of closers 3 on the same mounting means 4 can be quite desirable.

Figure 3:
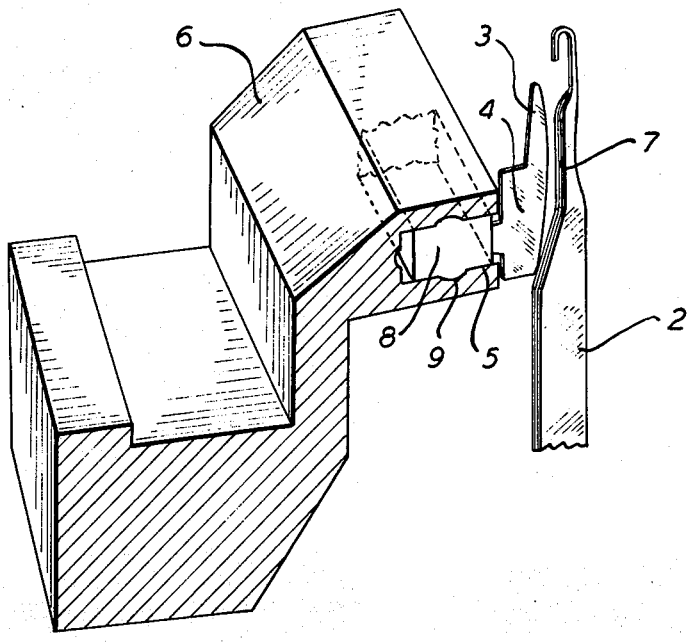
FIG. 3 is a cross sectional prospective view of the invention illustrated in FIG. 1.

FIG. 3 is a cross sectional prospective view of an embodiment of the present invention. According to FIG. 3 only one needle 2 and one extension 8 are shown for purposes of clarity. Additionally, the view of FIG. 3 is somewhat exploded, thereby separating the needle closer from the needle a little more than is actually the case. In actuality, of course, the closer 3 runs within the groove 7 of the needle.

The needle 2 is fixed in a needle holder. Holders of this type are well known and are not shown in this drawing. The closer mechanism 3 sits in an extension or sled 8 which for its part lies perpendicular to the needle 2 in the groove 5 of the closer holder 6. The sled 8 is free to slide within the groove 5 in a direction perpendicular to the needle 2. In conventional warp knitting machines the closer holder 6 may be attached to a pivoted lever whose axis of rotation corresponds to the axis of rotation of a lever controlling the needle holder, all of which controls the movement of the closer mechanism 3 in the groove 7 of the needle 2. In the manner previously described if the needle 2 is pulled somewhat out of position in a direction perpendicular to the slot, the sled 8 and the closer mechanism 3 will follow the needle 2 since the sled 8 is movable within the slot 5 of the closer holder 6. In order that the sled 8 can be led freely along the guide groove 5, it is frequently desirable to provide an additional rib 9 which runs in its own corresponding slot. A plurality of similar ribs are illustrated in FIG. 1. While ribs such as those disclosed as element 9 are frequently useful, they are not always necessary in the context of the broader aspect of this invention.

While the invention has been particularly shown and described with reference to the preferred embodiment thereof, it would be understood by those skilled in the art that various changes in form and detail may be made therein without departing from the spirit and scope of the invention.

What is claimed is:

1. A self-aligning apparatus for use on a warp knitting machine equipped with grooved needles, said apparatus comprising:

a needle means; a needle closer means adapted for interaction with said needle means; and a self-aligning means for automatically aligning said closer means with respect to said needle means, said self-aligning means comprising a closer mounting bar having a slot therein and, a slot engaging closer mounting means for carrying said closer means and adapted to move freely along the length of at least a portion of said slot.

2. The apparatus of claim 1 wherein said closer mounting means includes a plurality of three or more closer means rigidly mounted together thereon.

3. The apparatus of claim 1 wherein said needle means comprises an array of ground needles arranged in parallel fashion along a substantially straight axis.

4. The apparatus of claim 3 wherein said slot runs substantially parallel to the axis of said needle array; and further, wherein said slot only permits movement within said closing means in a direction parallel to said needle axis.

* * * * *